US005709574A

United States Patent [19]

Bianca et al.

[11] Patent Number: 5,709,574

[45] Date of Patent: Jan. 20, 1998

[54] SURFACE-MOUNTABLE SOCKET CONNECTOR

[75] Inventors: Giuseppe Bianca, Escondido; Robert M. Bogursky, Encintas, both of Calif.

[73] Assignee: Autosplice Systems Inc., San Diego, Calif.

[21] Appl. No.: 705,667

[22] Filed: Aug. 30, 1996

[51] Int. Cl.[6] ..... H01R 11/22

[52] U.S. Cl. ..... 439/858; 439/83

[58] Field of Search ..... 439/858, 79, 80, 439/81, 83, 856, 853, 876, 381, 857

[56] References Cited

U.S. PATENT DOCUMENTS

| | | | |
|---|---|---|---|
| 2,968,780 | 1/1961 | Roswell | 439/81 |
| 2,972,727 | 2/1961 | Flanagan, Jr. et al. | 439/82 |
| 3,315,219 | 4/1967 | Brinser et al. | 439/858 |
| 3,659,243 | 4/1972 | Gluntz | 439/858 |
| 3,824,557 | 7/1974 | Mallon | 439/381 |
| 3,953,096 | 4/1976 | Williams | 439/858 |
| 4,379,611 | 4/1983 | Foege et al. | 439/857 |
| 4,422,128 | 12/1983 | Zurlinden et al. | 439/81 |
| 4,575,167 | 3/1986 | Minter | 439/83 |
| 4,797,110 | 1/1989 | Ponziani et al. | 439/83 |

*Primary Examiner*—Gary F. Paumen
*Assistant Examiner*—Tho Dac Ta

[57] ABSTRACT

Surface mountable socket connector having first and second base portions providing for top, bottom, or horizontal entry of a male mating projecting member depending on the mounting position of the socket connector on a substrate such as a PCB. A spring contact member cantilevered at the first base portion, is configured to contact the projecting member via a hole at the first base portion or at an opposite end of the socket connector. The socket connectors are preferably fabricated from a continuous strip for loading onto a PCB by placement equipment.

7 Claims, 2 Drawing Sheets

SURFACE-MOUNTABLE SOCKET CONNECTOR

The invention relates to an electrical socket connector adapted for mounting using surface mounting technology (SMT) on a substrate, such as a printed circuit board (PCB) or the like.

BACKGROUND OF INVENTION

PCB assemblies comprise an insulating board provided with electrically-conductive traces interconnecting electrically-conductive pads on the board surface. In earlier times, electrical components were mounted on the PCB by inserting terminal leads of the component through conductive vias at pads on the PCB, and soldering the leads to the vias typically by wave soldering. As components and boards shrunk in size, surface mounting of the components using well known SMT became more popular. A feature of SMT is that placement equipment, sometimes called pick-and-place equipment, can be used to automate the process of placing the components, often under computer control, at their proper positions on the PCB. In this process, solder paste is placed on pre-determined pad positions, and a pneumatic device, typically a vacuum nozzle, is used to pick-up the component and place it on the solder paste. The solder paste holds the component in position during the solder reflow process. Components mounted in this manner include active and passive electrical components which are supplied to the placement equipment in packets in a tape unreeled from a reel. PCBs require from time to time electrical connectors. Electrical connectors include both male connectors with pins as well as female connectors with sockets for receiving the pins on a male connector, for example terminating an electrical cable.

SUMMARY OF INVENTION

A principal object of the invention is a socket connector for surface mounting to a substrate;

Another object of the invention is a SMT socket connector that has a low profile;

Still another object of the invention is a versatile socket connector capable of receiving a male contact from several different directions.

These and other objects are achieved in accordance with one feature of the invention by a socket connector comprising a generally U-shaped member having at its legs at opposite ends holes for receiving a contact of a male connector. A spring contact member is mounted at the legs of the U so as to engage a contact member which enters the socket connector via either of its holes.

In accordance with a further feature of the invention, the socket connector is configured to mount using SMT on a PCB or other substrate via a first base portion constituting one of its legs, or via a second base portion constituting its bight portion (the part of the U between its legs). When mounted on its first base portion, it can receive a contact member for vertical entry via its top or via its bottom through a hole in the substrate. When mounted on its second base portion, it can receive a contact member for horizontal entry.

In accordance with a preferred embodiment of the invention, the socket connector is configured to be formed as a one-piece member from a continuous strip of metal which can be directly placed into a feeder for indexing and separation in placement equipment, or which can be individually separated from the strip and placed into an embossed carrier tape for automatic pick-and-place by a robotic device.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described the preferred embodiments of the invention, like reference numerals or letters signifying the same or similar components.

DETAILED DESCRIPTION OF PREFERRED EMBODIMENTS

Figure 1:
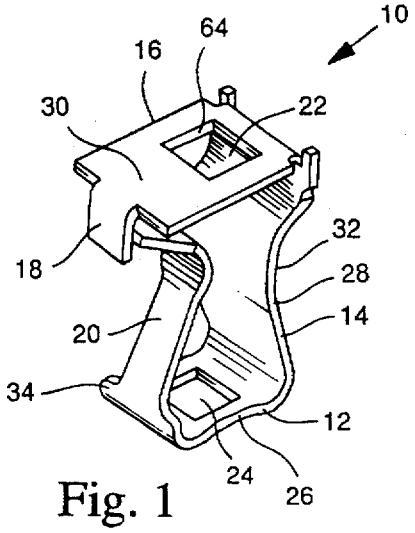
FIG. 1 is a perspective view of one form of socket connector in accordance with the invention.

FIG. 1 illustrates one form of socket connector in accordance with the invention. The most important application of the invention is the provision of socket connectors for SMT mounting on PCBs for receiving contact members in the form of male pins of connectors. However, the invention is not limited to male pins nor to PCBs, nor necessarily to SMT mounting. The socket connector of the invention can be used with any kind of substrate that has conductive areas for electrical connection to the socket, and the socket connectors can be configured with different shapes of openings for receiving a projecting member of various shapes and sizes. While a common purpose would be to establish an electrically-conductive contact between an electrically-conductive portion on the projecting member and an electrically-conductive part on the substrate, the latter need not be a pad on the substrate but could also be a wall of a substrate hole or other electrically-conductive member on a surface of or buried within the substrate. More, while the more common usage would involve circular or square male contact members engaging square or circular holes in the socket connector, the invention is also applicable to contact members such as lugs, tabs, posts or the like possessing non-circular cross-sections for engaging non-circular holes, as well as to pins having rectangular or hexagonal cross-sections. However, to simplify the description, with the understanding that the invention is not so limited, the invention will be described and illustrated in the most common application employing in this case, as the contact member, a SMT socket connector 10 intended to receive a contact member in the form of a male pin of a connector for establishing an electrical connection between a wire connected to the connector and a component on a PCB and connected via a conductive trace to the socket connector 10.

Figure 2:
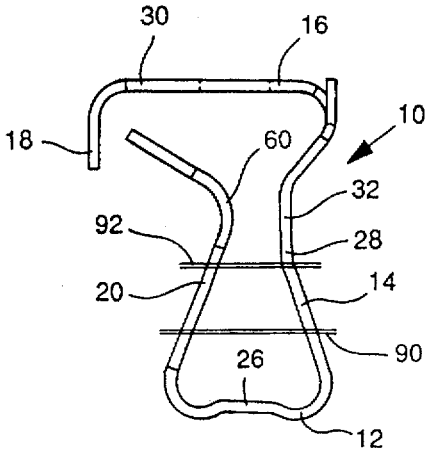
FIGS. 2 and 3 are side and top views, respectively, of the socket connector of FIG. 1.
Figure 3:
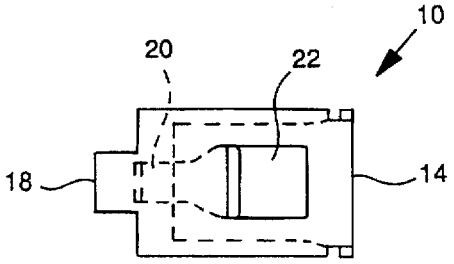

The socket connector 10 comprises, in the position shown, a generally U-shaped member with spaced horizontal legs 12, 16 joined by a bight portion 14, forming a horizontally-extending first base portion previously designated as 12, connected to a vertically-extending second base or frame portion previously designated as the bight portion 14, in turn connected to a top portion previously designated as 16 which extends generally parallel to the first base portion 12 forming the generally U-shaped configuration standing on one leg or side 12. The top portion 16 terminates in a depending stop portion 18, which extends generally parallel to the second base portion 14. Cantilevered up from the front edge of the first base portion 12 is a contact spring portion 20. Square holes 22, 24 that are vertically aligned are present in the top 16 and first base portion 12, respectively. FIGS. 2 and 3 are side and top views, respectively, of the socket connector of FIG. 1.

The hole 24 in the bottom portion 12 is surrounded by a raised portion 26 so that, when the socket connector 10 is placed upright as shown in FIG. 1 on a surface, the raised portion 26 surrounding the hole 24 is spaced above the surface, referred to herein as a first stand-off. Similarly, if the socket connector 10 were placed on a surface with the second base portion 14 down, the center region 28 of the second base portion 14 would also be raised above the surface to form a second stand-off. The top portion 16 has a first flat pick-up area 30 which permits the socket connector 10 to be picked up vertically for automatic placement by vacuum positioning equipment. A second flat pick-up area 32 is formed by a region of the center region 28 of the second base portion 14. The contact spring portion 20 is cantilevered via a wide base 34 to the first base portion 12, but the remainder of the spring portion 20 is narrower, about one-half the width of the base portion 34.

Figure 4:
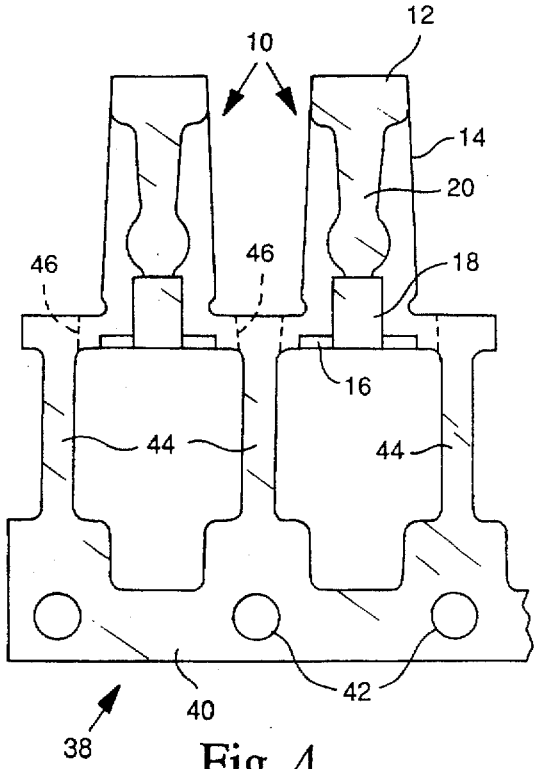
FIG. 4 is a partial plan view showing how the socket connector of FIG. 1 can be fabricated in strip form.

The socket connector 10 is manufactured from a continuous strip 38 of beryllium-copper alloy to provide spring temper and good electrical conductivity. FIG. 4 illustrates an end of the continuous strip 38, which comprises an elongated carrier with holes 42 for receiving the sprockets of an indexing mechanism (not shown). Typically, the holes and other cutouts would first be punched, and then the parts bent and folded to form the configuration of FIG. 1, but still connected to the carrier 40 via struts 44. When the struts 44 are severed along the lines 46, individual one-piece socket connectors 10 can be separated from the carrier 40. After the strip of socket connectors 10 is fabricated, it is conveniently reeled up on a reel 48 (FIG. 5) and in that form can be shipped to a customer for use. At the customer's premises, the strip 38 would be unreeled and individual socket connectors 10 severed from the strip 38 for manual or automatic positioning onto a PCB.

Figure 6:
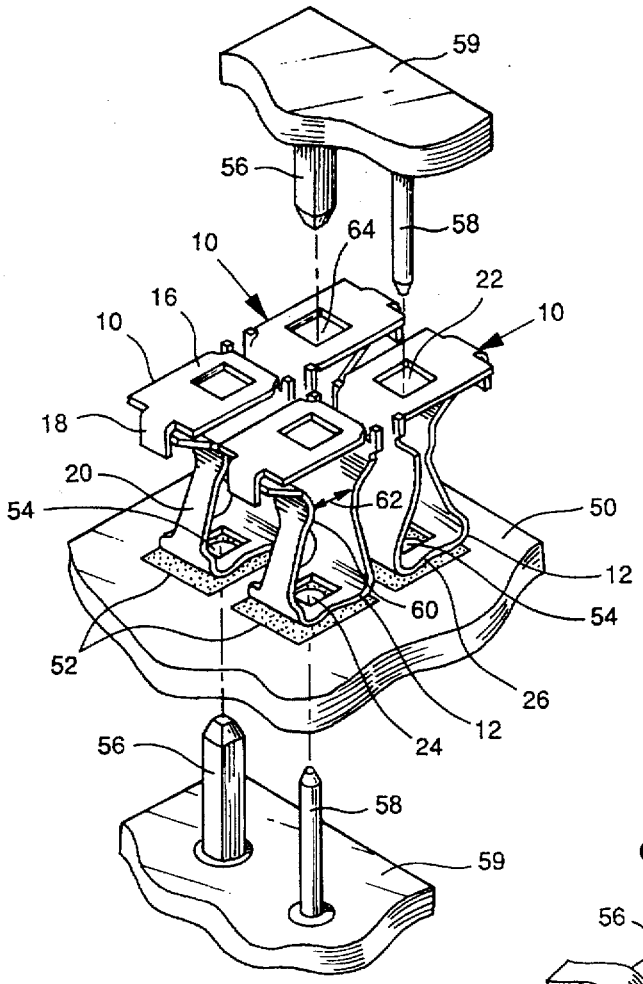
FIGS. 6 and 7 show different mounting arrangements of the socket connector of FIG. 1 for vertical and horizontal entry of a pin connector.

A feature of the invention is that the socket connector 10 has a low profile, and can be surface-mounted to a PCB in either of two positions for receiving a mating pin of a male connector for top, bottom, or horizontal entry. FIG. 6 illustrates a part of a PCB 50 provided with four contact pads 52. On each is soldered a socket connector 10 with their first base portion 12 on the pad 52. If the pad 52 and PCB 50 are provided with through-holes 54, bottom entry of a square 56 or round pin 58 of a male connector 59 via the through-hole 54 into the socket 10 via its bottom hole can be effected. The contact spring 20 has an inwardly bent contact region 60 spaced a predetermined distance, shown at 62, from the facing surface of the frame portion 14. That spacing 62 is slightly smaller than the thickness or width of the contact pins 56, 58, so that when the latter enter the connector 10, the contact spring 20 is moved laterally in FIG. 6 so that the pins 56, 58 are engaged under pressure from opposite sides by the contact region 60 and facing surface of the frame side 14 providing a solid reliable electrical connection between the pins 56, 58 of the male connector 59 and a contact pad 52 via the socket 10. Alternatively, top entry to the socket connector 10 of the pins 56, 58 is possible via the top opening 22. The bent shape of the contact region 60 allows easy entry from the top or bottom of the socket. Also facilitating entry of a mating pin is a beveled spring entry area 64 at top and bottom completely surrounding (360°) each connector opening 22, 24 helping to guide the mating pin into the socket.

Figure 7:
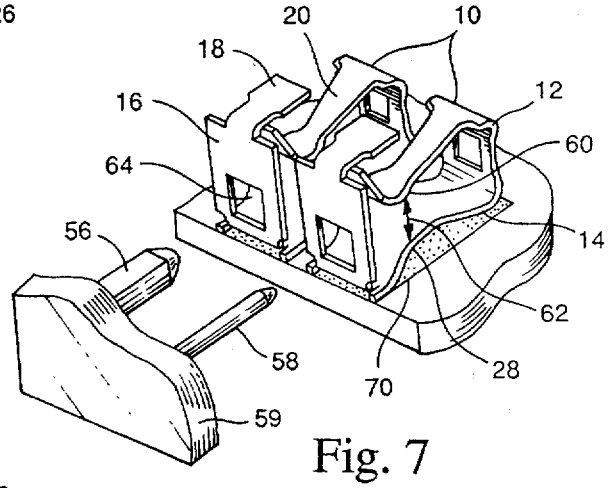

FIG. 7 illustrates a PCB portion 50 with rectangular contact pads 70 on which are soldered socket connector 10 laid on their second base portion 14, allowing horizontal entry of pins 56, 58 of a male connector 59.

A further feature of the invention is the provision of the stop 18, which is positioned to limit the deflection of the spring contact 20 by engaging and stopping a free end of the contact member 20. This prevents the spring from being permanently damaged by excessive stress. Also, the narrow width of the spring contact 20, cantilevered from the wider base 34, isolate stresses generated from engagement and disengagement of the pins away from the solder joints to the pads and prevents joint damage.

Figure 5:
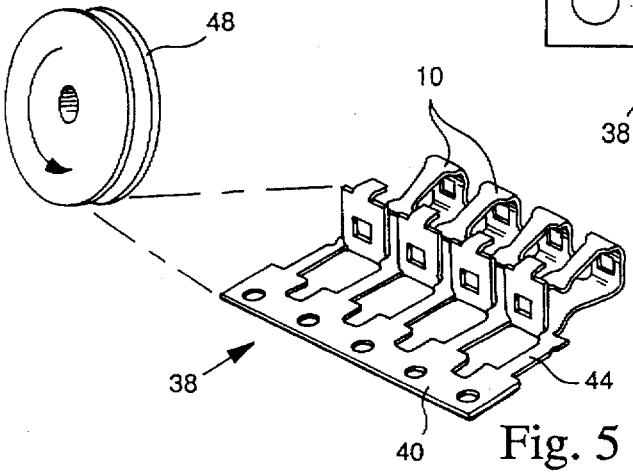
FIGS. 5 shows one way in which the socket connector of the invention can be supplied to a customer for assembling onto substrates.

As mentioned in connection with FIG. 5, the strip of connectors on a reel 48 can supply individual connectors when placed directly into a feeder for indexing and separation in conventional placement equipment. The part 10, when severed, can be automatically picked-and-placed by mechanical or pneumatic devices which places the part on the PCB 50 in a predetermined position on contact pad 52, 70 which has been previously coated with solder paste (not shown). The solder paste holds the socket 10 in place during a typical solder reflow process. The solder connection provides the mechanical and electrical bond of the PCB and the socket. The solder area is raised from the PCB surface at the raised portion 26 when mounted vertically, or at the center region 28 when mounted horizontally. This prevents solder wicking into the socket contact regions at 60. The contact mating surfaces are also positioned away from the reflowing solder.

The regions 30, 32 serve as flat pick-up areas for a vacuum nozzle which permits the socket connector 10 to be picked up vertically or horizontally for automatic placement by positioning equipment.

Figure 8A:
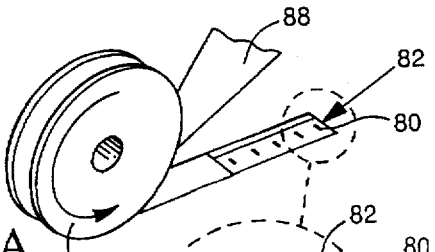
FIG. 8A shows another way in which the socket connector of the invention can be supplied to a customer for assembly onto substrates.
Figure 8B:
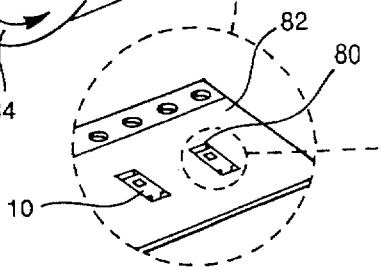
FIG. 8B is an enlarged view of the circled part of FIG. 8A.
Figure 8C:
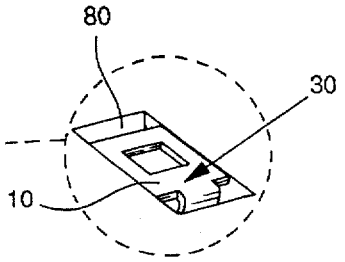
FIG. 8C is an enlarged view of the circled part of FIG. 8B.

The individual sockets 10 can be severed from the strip 38 and packaged individually in pockets 80 in a plastic tape 82 supplied by a reel 84 as shown in FIGS. 8A–8C, like other electrical components. FIG. 8C also shows the pick-up area 30 on the socket 10. Numeral 88 designates the plastic cover strip that is removed to allow access by a pick-up nozzle to the socket 10.

Several practical examples, which are not to be considered limiting, will now be given for certain industry standard pin sizes, typically a 0.018 inches round pin and a 0.025 inches square pin. The size of a typical pick-up area is about 0.05×0.075 inches to receive a 1 mm nozzle for a socket 10 having a height of about 0.175 inches and a width of about 0.075 inches for receiving the 0.018 or 0.025 pin. The spacing 62 in this exemplary embodiment would be about 0.013 inches and about 0.020 inches for the round and square pins, respectively. Preferably, the part below the lines 90 in FIG. 2 are tin-lead plated, and the part above the lines 92 gold-plated.

Socket connectors with the dimensions indicated allow the connectors to be positioned side-by-side in a group to mate with an array of pins.

While the invention has been described in connection with preferred embodiments, it will be understood that modifications thereof within the principles outlined above will be evident to those skilled in the art and thus the invention is not limited to the preferred embodiments but is intended to encompass such modifications.

What is claimed is:

1. In combination;

a substrate having an electrical part, and a socket connector surface mounted and soldered on the substrate and electrically connected to the electrical part, said socket connector comprising:

(a) a generally U-shaped member having spaced generally parallel legs and a bight portion, (b) each of said legs having a hole for receiving a projecting member, (c) one of said legs forming a first base portion for vertical mounting and soldering of the socket connector on the substrate, (d) the bight portion forming a second base portion for horizontal mounting and soldering of the socket connector on the substrate, said socket connector being surface mounted and soldered on the substrate at its one leg or at its bight portion.

(e) a spring contact member mounted to one of the legs and positioned opposite the bight portion for contacting a projecting member when inserted into one of the holes.

2. The combination as claimed in claim 1, wherein the one leg having the hole has a raised portion, the hole being in the raised portion and spaced from the substrate such that solder wicking to the hole is prevented when the first base portion is soldered to the substrate.

3. The combination as claimed in claim 1, wherein each of the first and second base portions has a raised center section to standoff of the substrate to minimize solder wicking when the first or second base portion is soldered to the substrate.

4. The combination as claimed in claim 1, wherein each of the other of the legs and the second base portion has a flat pick-up area sized for pick-up by a vacuum nozzle of pick and place equipment.

5. The combination as claimed in claim 1, wherein the spring contact member is cantilevered from an end of the first base portion and forms a bent contact region spaced from a facing surface of the bight portion by a distance slightly smaller than the width of the projecting member.

6. The combination as claimed in claim 5, further comprising a stop member depending from an end of the other of the legs, said spring contact member having a free end positioned to engage the stop member when subjected to excessive stress.

7. The combination as claimed in claim 6, wherein the spring contact member comprises a narrowed portion connected by a wider portion to the end of the first portion.

* * * * *